US005556096A

United States Patent [19]

Eardley et al.

[11] Patent Number: 5,556,096

[45] Date of Patent: Sep. 17, 1996

[54] DICE

[76] Inventors: Alfred A. C. Eardley, 20A Mayfield Avenue, Orpington, Kent BR6 0AL, United Kingdom; Darryl Eardley, 139 Aillcrest Rd., Bromley, Kent; Blake Eardley, 23 Blackhorse Rd., Sidcup, Kent, both of United Kingdom

[21] Appl. No.: 219,019

[22] Filed: Mar. 28, 1994

Related U.S. Application Data

[63] Continuation-in-part of Ser. No. 768,705, Oct. 18, 1991, abandoned.

[51] Int. Cl.[6] ..... A63F 9/04

[52] U.S. Cl. ..... 273/146

[58] Field of Search ..... 273/146

[56] References Cited

U.S. PATENT DOCUMENTS 1,563,680 12/1925 Zwirner ..... 273/146

1,765,625 6/1930 Snover ..... 273/146

FOREIGN PATENT DOCUMENTS 686287 7/1930 France ..... 273/146

820991 11/1937 France ..... 273/146

877273 5/1953 Germany ..... 273/146

OTHER PUBLICATIONS

"Money Cubes", Teaching Resources Catalog 1982, p. 404.

*Primary Examiner*—Benjamin H. Layno

*Attorney, Agent, or Firm*—Bauer & Schaffer

[57] ABSTRACT

Dice are disclosed which are generally spherical and which have a multiplicity of flat faces bearing indicia—symbols, letters, numerals or the like formed thereon by cutting, etching or engraving. The faces are arranged in opposed identical pairs with their centers lying on axes passing through the center of the die. In passing through the center of the die the axes may be symmetrically spaced one from the other or be arranged such that their angular spacing in both bearing and elevation is maximized.

5 Claims, 3 Drawing Sheets

DICE

This application is a continuation-in-part of U.S. Ser. No. 07/768,705 filed Oct. 18, 1991, abandoned.

FIELD OF THE INVENTION

The present invention relates to dice and, more particularly, to dice having a number of faces some or all of which carry indicia and which may be cast or thrown to select at random between any one of those indicia.

BACKGROUND OF THE INVENTION

Dice have been known for many years to comprise a regular cuboid shape fabricated from a material of constant density with each of the six faces carrying one of a number (between one and six) spots. The regular shape of such dice means that they are unbiased and one of the six faces will be uppermost when the die comes to rest after having been thrown or cast by a user, the particular face being selected at random by the fall of the die.

Dice having four faces have been proposed (each face being an equilateral triangle) which have proven to be, when made properly, effective at selecting a number at random—they are unbiased.

Although attempts have been made to produce dice with more than six faces which are unbiased, these attempts have not been successful. French Patent No. 686,287 discloses a die in the form of a generally spherical body including substantially identical faces arranged in pairs having centers on ends of diameters passing through the center of the die. Thirty-eight faces are provided and are shown as concave depressions. However, those thirty-eight faces are not all evenly distributed over the otherwise spherical die body. Hence, such known dice are not essentially unbiased.

U.S. Pat. No. 3,195,895 discloses dice which are exemplary of dice formed by taking a regular polyhedron and lopping its corners to form faces having different dimensions and configurations. As a result these known dice are not free from bias. Furthermore, the angular spacings between axes defining pairs of the faces as the axes pass through the center of the die lack symmetry.

SUMMARY OF THE INVENTION

In view of the aforementioned shortcomings, it is an object of the present invention to provide dice having more than six faces and which are substantially unbiased.

In one aspect of the present invention, a die comprises a center and a plurality of faces arranged in opposed pairs on opposite sides of the center. The faces are substantially identical and substantially equally spaced from the center of the die. Each face includes a center point substantially lying on an axis passing substantially through the center of the die. The axes passing through the center of the die are substantially symmetrically spaced one from the other relative to the center of the die.

In another aspect of the present invention, a die comprises a center and a plurality of faces arranged in opposed pairs on opposite sides of the center. The faces are substantially identical and substantially equally angularly spaced from the center of the die. Each face includes a center substantially lying on an axis passing substantially through the center of the die. The angular spacing between the axes passing through the center of the die is maximised in both bearing and elevation.

BRIEF DESCRIPTION OF THE DRAWINGS

The foregoing summary, as well as the following detailed description of preferred embodiments of the invention, will be better understood when read in conjunction with the appended drawings. For the purpose of illustrating the invention, there is shown in the drawings an embodiment which is presently preferred. It should be understood, however, that the invention is not limited to the precise arrangements and instrumentalities shown. In the drawings.

DETAILED DESCRIPTION OF PREFERRED EMBODIMENTS

While this invention is susceptible of embodiments in many different forms, this specification and the accompanying drawings disclose only some specific forms as examples of the use of the invention. The invention is not intended to be limited to the embodiments so described, and the scope of the invention will be pointed out in the appended claims.

Figure 1:
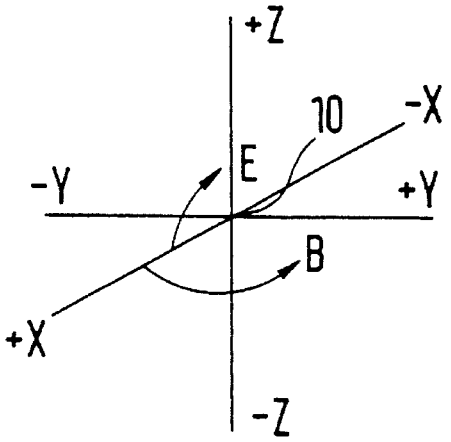
FIG. 1 diagrammatically illustrates the three cartesian coordinates, X, Y, Z, and the angular bearing and elevation conventions used in the specification.

Referring now to the drawings in detail, FIG. 1 illustrates the three mutually orthogonal axes X, Y, and Z extending in positive and negative directions from an origin 10 and from which the position of any point may be defined by using the cartesian coordinates of the point—the distances of the point from the origin along the X, Y, and Z axes. For example, the position of the origin 10 is defined by the coordinates 0, 0, 0 for X, Y and Z respectively. The origin 10 defines the center of the dice which will be described below with reference to FIGS. 2A, 2B, 3A, 3B, 4A and 4B.

FIG. 1 also illustrates the convention used for defining the bearing (B) and elevation (E) angles used in this specification. As can be seen, the bearing angle (B) is measured from the X (positive) axis and increases in a direction counterclockwise around the Z axis in the X-Y plane. The elevation angle (E) is measured from the X (positive) axis and increases in a direction clockwise around the Y axis in the X-Z plane. The position of any point may be defined by using the bearing (B) and elevation (E) of the point from the reference axes and the distance of that point from the origin.

Figure 2A:
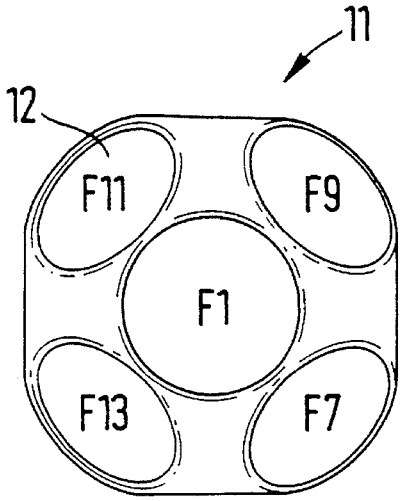
FIG. 2A is a plan view of a die in accordance with a first embodiment of the present invention employing fourteen faces.

FIG. 2A illustrates a plan view of a first preferred embodiment of a die, generally designated 11, according the the present invention employing fourteen faces 12. The surface of the die 11 between the faces 12 is rounded—that is to say, the faces are formed as flats on a sphere. The faces are arranged in opposed pairs on opposite sides of the center 10 of the die 11. The faces 12 are substantially identical and substantially equiangularly spaced from the center 10 of the die 11. Each face 12 includes a center point substantially lying on an axis passing substantially through the center 10 of the die 11 as further described below.

Figure 2B:
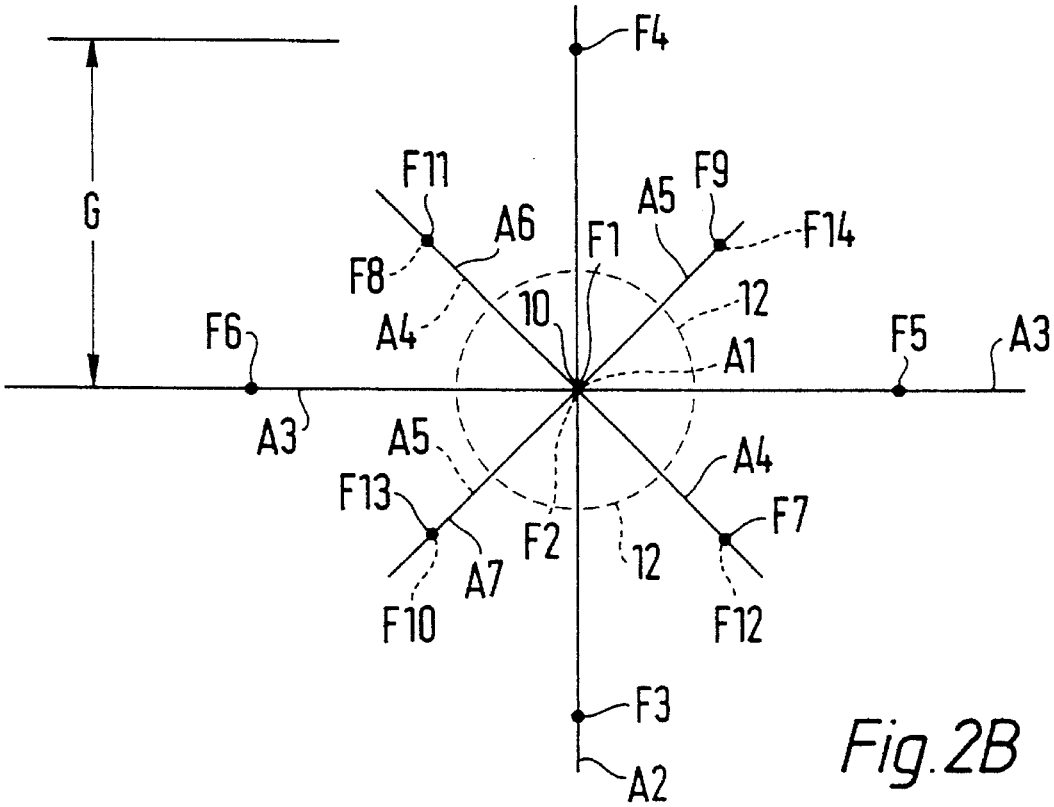
FIG. 2B is a diagrammatical illustration of the arrangement of the axes joining opposed pairs of faces of the die in FIG. 2A as viewed along the Z axis illustrated in FIG. 1.

FIG. 2B is a diagrammatic view (looking along the Z axis in FIG. 1 toward the X-Y plane) illustrating the relative positions of the seven axes A1, A2, A3, A4, A5, A6 and A7 joining the seven opposed pairs of faces 12 making up the fourteen faces of the die. The axes pass through the center 10 of the die and are substantially symetrically spaced from one another relative to the center 10. Alternatively, the axes may be arranged such that their angular spacing in both bearing and elevation is maximized.

In FIG. 2B only one face is shown (in dotted outline at 12), and the center point of each of the fourteen faces 12 are indicated at F1, F2, F3, F4, . . . F13, F14. The center points of opposed pairs of faces 12 lie substantially on the axis joining them. The faces 12 are substantially identical in size and lie at substantially the same distance G from the center 10 of the die 11. Each face 12 is disposed in a plane substantially normal to the axis on which it lies.

The bearing and elevation of each axis of the die 11 according to the present embodiment is given in substance in Table 1A, which also indicates which faces of the die lie on each axis.

TABLE 1A

| AXIS | BEARING(°) | ELEVATION (°) | FACES |
|---|---|---|---|
| A1 | * | 90.00 | 1, 2 |
| A2 | 0.00 | 0.00 | 3, 4 |
| A3 | 90.00 | 0.00 | 5, 6 |
| A4 | 45.00 | $\mathrm{Sin}^{-1}(1/3)^{1/2}$ | 7, 8 |
| A5 | 135.00 | $\mathrm{Sin}^{-1}(1/3)^{1/2}$ | 9, 10 |
| A6 | 225.00 | $\mathrm{Sin}^{-1}(1/3)^{1/2}$ | 11, 12 |
| A7 | 315.00 | $\mathrm{Sin}^{-1}(1/3)^{1/2}$ | 13, 14 |

(*the bearing of this axis may be assigned any value between 0° and 360°).

The cartesian coordinates of the center points of the faces 12 of the die 11 in the present embodiment are substantially as shown in Table 1B.

TABLE IB

| FACE | COORDINATES (X,Y,Z) | | |
|---|---|---|---|
| 1 | 0 | 0 | 1 |
| 2 | 0 | 0 | −1 |
| 3 | 1 | 0 | 0 |
| 4 | −1 | 0 | 0 |
| 5 | 0 | 1 | 0 |
| 6 | 0 | −1 | 0 |
| 7 | $1/3^{1/2}$ | $1/3^{1/2}$ | $1/3^{1/2}$ |
| 8 | $-1/3^{1/2}$ | $-1/3^{1/2}$ | $-1/3^{1/2}$ |
| 9 | $-1/3^{1/2}$ | $1/3^{1/2}$ | $1/3^{1/2}$ |
| 10 | $1/3^{1/2}$ | $-1/3^{1/2}$ | $-1/3^{1/2}$ |
| 11 | $-1/3^{1/2}$ | $-1/3^{1/2}$ | $1/3^{1/2}$ |
| 12 | $1/3^{1/2}$ | $1/3^{1/2}$ | $-1/3^{1/2}$ |
| 13 | $1/3^{1/2}$ | $-1/3^{1/2}$ | $1/3^{1/2}$ |
| 14 | $-1/3^{1/2}$ | $1/3^{1/2}$ | $-1/3^{1/2}$ |

It will be appreciated that the configuration described above for the die of the present embodiment provides that the die, when rolled, is essentially unbiased.

The die 11 in the present embodiment may be fabricated by a molding process in a mold of a desired configuration from a suitable plastic material. However, it is understood by those skilled in the art that other fabrication methods and materials are suitable for the die 11. For example, the die may be fabricated by molding in a mold producing a sphere and thereafter cutting or grinding the sphere to produce the faces.

Figure 3A:
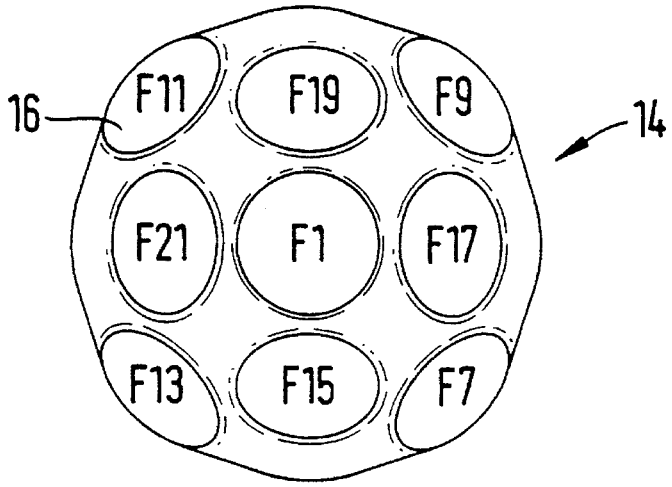
FIG. 3A is a plan view of a die in accordance with a second embodiment of the present invention employing twenty-six faces.
Figure 3B:
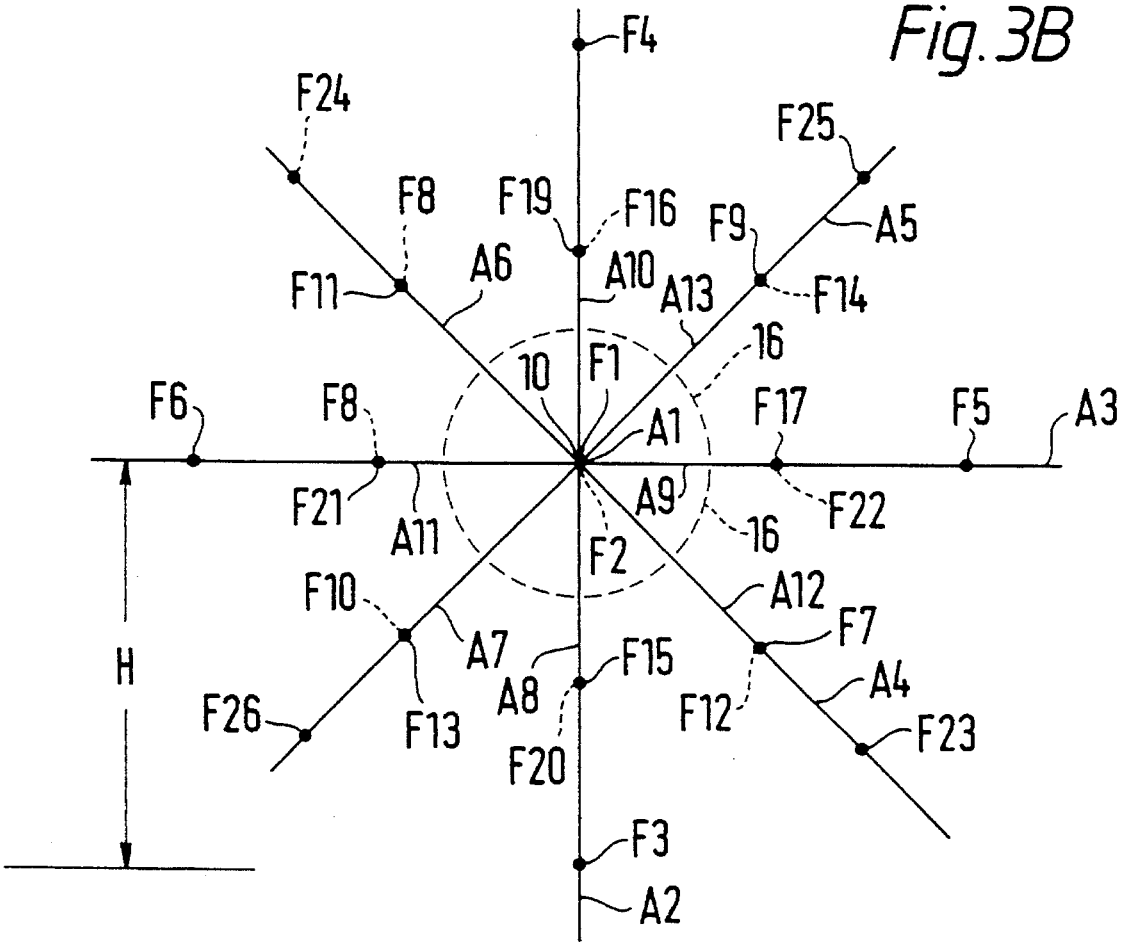
FIG. 3B is a diagrammatical illustration of the arrangement of the axes joining opposed pairs of faces of the die in FIG. 3A as viewed along the Z axis shown in FIG. 1.

A dice, generally designated 14, according to a second embodiment of the invention, as shown in FIGS. 3A and 3B, includes the essential elements of the die previously described with reference to FIGS. 1, 2A and 2B. However, in the second embodiment the die 14 includes twenty-six faces 16.

As with first embodiment described above with reference to FIGS. 2A and 2B, the surface of the die 14 between the faces 16 is rounded—that is to say, the faces are formed as flats on a sphere. The faces are arranged in opposed pairs on opposite sides of the center 10 of the die 14. The faces 16 are substantially identical and substantially equiangularly spaced from the center 10 of the die 14. Each face 16 includes a center point substantially lying on an axis passing substantially through the center 10 of the die 14 as further described below.

FIG. 3B is a diagrammatic view (looking along the Z axis in FIG. 1 toward the X-Y plane) illustrating the relative positions of the thirteen axes A1, A2, A3, . . . A13 joining the thirteen opposed pairs of faces 16 making up the twenty-six faces of the die. The axes pass through the center 10 of the die and are substantially symetrically spaced from one another relative to the center 10. Alternatively, the axes may be arranged such that their angular spacing in both bearing and elevation is maximized.

In FIG. 2B only one face is shown (in dotted outline at 16), and the center point of each of the twenty-six faces 16 are indicated at F1, F2, F3, F4, . . . F13, F26. The center points of opposed pairs of faces 16 lie substantially on the axis joining them. The faces 16 are substantially identical in size and lie at substantially the same distance H from the center 10 of the die 14. Each face 16 is disposed in a plane substantially normal to the axis on which it lies.

The bearing and elevation of each axis of the die 14 according to the present embodiment is given in substance in Table 2A, which also indicates which faces of the die lie on each axis.

TABLE 2A

| AXIS | BEARING (°) | ELEVATION (°) | FACES |
|---|---|---|---|
| A1 | * | 90.00 | 1, 2 |
| A2 | 0.00 | 0.00 | 3, 4 |
| A3 | 90.00 | 0.00 | 5, 6 |
| A4 | 45.00 | $\mathrm{Sin}^{-1}(1/3)^{1/2}$ | 7, 8 |
| A5 | 135.00 | $\mathrm{Sin}^{-1}(1/3)^{1/2}$ | 9, 10 |
| A6 | 225.00 | $\mathrm{Sin}^{-1}(1/3)^{1/2}$ | 11, 12 |
| A7 | 315.00 | $\mathrm{Sin}^{-1}(1/3)^{1/2}$ | 13, 14 |
| A8 | 0.00 | 45.00 | 15, 16 |
| A9 | 90.00 | 45.00 | 17, 18 |
| A10 | 180.00 | 45.00 | 19, 20 |
| A11 | 270.00 | 45.00 | 21, 22 |
| A12 | 45.00 | 0.00 | 23, 24 |
| A13 | 135.00 | 0.00 | 25, 26 |

(*the bearing of this axis may be assigned any value between O° and 360°).

The cartesian coordinates of the center points of the faces 16 of the die 14 in the present embodiment are substantially as shown in Table 2B.

TABLE 2B

| FACE | COORDINATES (X,Y,Z) | | |
|---|---|---|---|
| 1 | 0 | 0 | 1 |
| 2 | 0 | 0 | −1 |
| 3 | 1 | 0 | 0 |
| 4 | −1 | 0 | 0 |
| 5 | 0 | 1 | 0 |
| 6 | 0 | − | 0 |
| 7 | $1/3^{1/2}$ | $1/3^{1/2}$ | $1/3^{1/2}$ |
| 8 | $-1/3^{1/2}$ | $-1/3^{1/2}$ | $-1/3^{1/2}$ |
| 9 | $-1/3^{1/2}$ | $1/3^{1/2}$ | $1/3^{1/2}$ |
| 10 | $1/3^{1/2}$ | $-1/3^{1/2}$ | $-1/3^{1/2}$ |
| 11 | $-1/3^{1/2}$ | $-1/3^{1/2}$ | $1/3^{1/2}$ |
| 12 | $1/3^{1/2}$ | $1/3^{1/2}$ | $-1/3^{1/2}$ |
| 13 | $1/3^{1/2}$ | $-1/3^{1/2}$ | $1/3^{1/2}$ |
| 14 | $-1/3^{1/2}$ | $1/3^{1/2}$ | $-1/3^{1/2}$ |
| 15 | $1/2^{1/2}$ | 0 | $1/2^{1/2}$ |
| 16 | $-1/2^{1/2}$ | 0 | $-1/2^{1/2}$ |
| 17 | 0 | $1/2^{1/2}$ | $1/2^{1/2}$ |
| 18 | 0 | $-1/2^{1/2}$ | $-1/2^{1/2}$ |
| 19 | $-1/2^{1/2}$ | 0 | $1/2^{1/2}$ |
| 20 | $1/2^{1/2}$ | 0 | $-1/2^{1/2}$ |
| 21 | 0 | $-1/2^{1/2}$ | $1/2^{1/2}$ |
| 22 | 0 | $1/2^{1/2}$ | $-1/2^{1/2}$ |
| 23 | $1/2^{1/2}$ | $-1/2^{1/2}$ | 0 |
| 24 | $-1/2^{1/2}$ | $-1/2^{1/2}$ | 0 |
| 25 | $-1/2^{1/2}$ | $1/2^{1/2}$ | 0 |
| 26 | $1/2^{1/2}$ | $-1/2^{1/2}$ | 0 |

It will be appreciated that the configuration described above for the die of the present embodiment provides that the die, when rolled, is essentially unbiased.

The dice 14 of the present invention may be fabricated by a similar method and using the materials as described above with reference to FIGS. 2A and 2B.

Figure 4A:
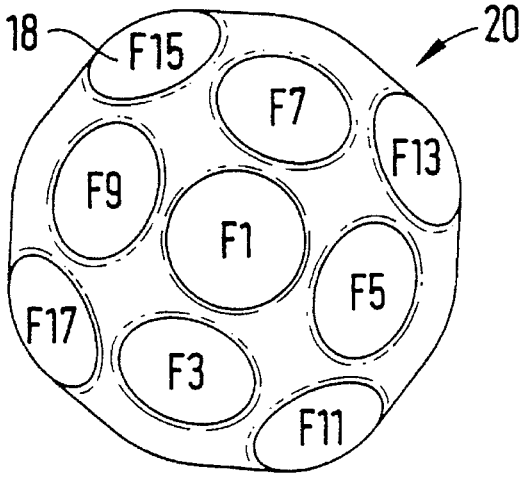
FIG. 4A is a plan view of a die in accordance with a third embodiment of the present invention employing twenty-six faces.
Figure 4B:
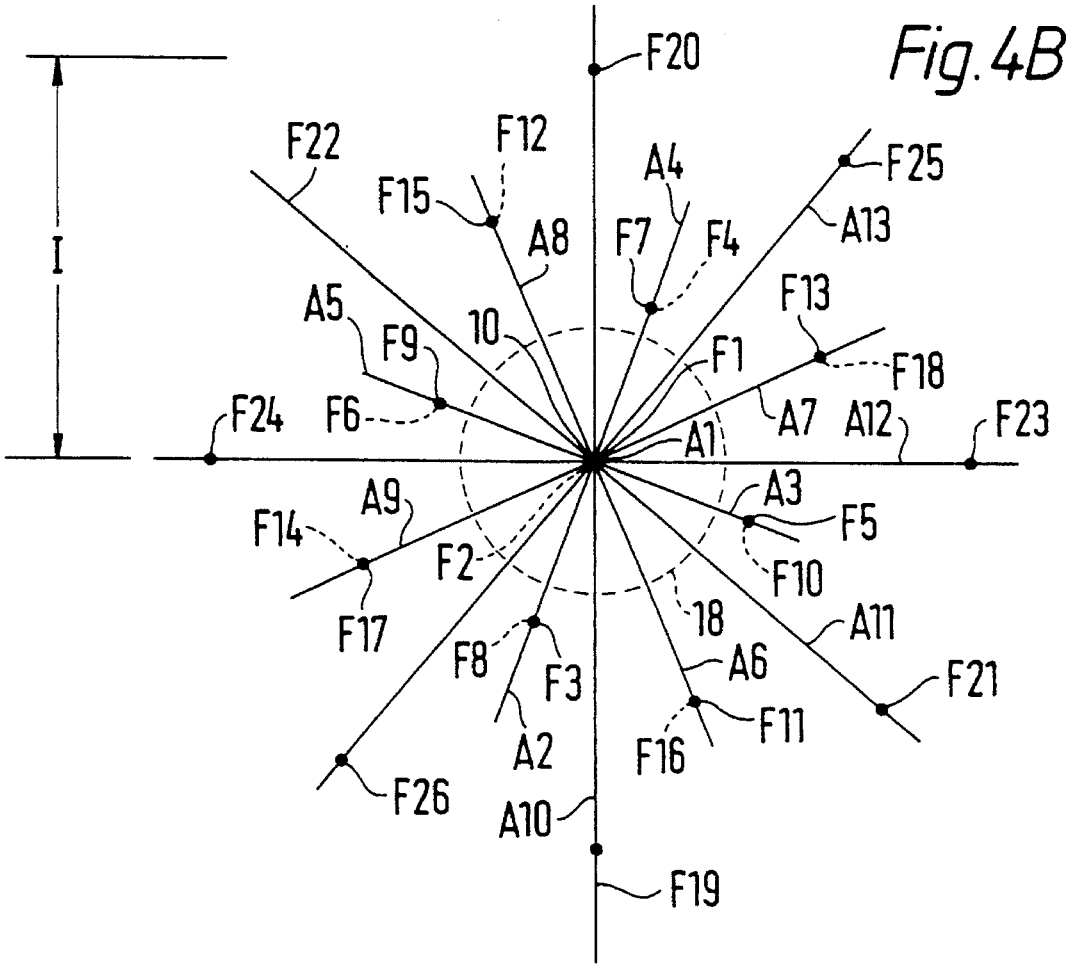
FIG. 4B is a diagrammatical illustration of the arrangement of the axes joining opposed pairs of faces of the die in FIG. 4A as viewed along the Z axis shown in FIG. 1.

A dice, generally designated 20, according to a third embodiment of the invention, as shown in FIGS. 4A and 4B, includes the essential elements of the die previously described with reference to FIGS. 1, 2A, 2B, 3A and 3B. However, in the third embodiment the die 20 includes twenty-six faces 18.

As with first and second embodiments described above with reference to FIGS. 2A, 2B, 3A and 3B, the surface of the die 20 between the faces 18 is rounded—that is to say, the faces are formed as flats on a sphere. The faces are arranged in opposed pairs on opposite sides of the center 10 of the die 20. The faces 18 are substantially identical and substantially equiangularly spaced from the center 10 of the die 20. Each face 18 includes a center point substantially lying on an axis passing substantially through the center 10 of the die 20 as further described below.

FIG. 4B is a diagrammatic view (looking along the Z axis in FIG. 1 toward the X-Y plane) illustrating the relative positions of the thirteen axes A1, A2, A3, . . . A13 joining the thirteen opposed pairs of faces 18 making up the twenty-six faces of the die. The axes are arranged relative to the center 10 to provide substantially for their maximum separation, such that their angular spacing in both bearing and elevation is maximized.

In FIG. 4B only one face is shown (in dotted outline at 18), and the center point of each of the twenty-six faces 18 are indicated at F1, F2, F3, F4, . . . F13, F26. The center points of opposed pairs of faces 18 lie substantially on the axis joining them. The faces 18 are substantially identical in size and lie at substantially the same distance I from the center 10 of the die 20. Each face 16 is disposed in a plane substantially normal to the axis on which it lies.

The bearing and elevation of each axis of the die 20 according to the present embodiment is given in substance in Table 3, which also indicates which faces of the die lie on each axis.

TABLE 3

| AXIS | BEARING (°) | ELEVATION (°) | FACES |
|---|---|---|---|
| A1 | * | 90.00 | 1, 2 |
| A2 | 0.00 | 51.04 | 3, 4, |
| A3 | 90.00 | 51.04 | 5, 6 |
| A4 | 180.00 | 51.04 | 7, 8 |
| A5 | 270.00 | 51.04 | 9, 10 |
| A6 | 45.00 | 30.49 | 11, 12 |
| A7 | 135.00 | 30.49 | 13, 14 |
| A8 | 225.00 | 30.49 | 15, 16 |
| A9 | 315.00 | 30.48 | 17, 18 |
| A10 | 19.48 | 0.00 | 19, 20 |
| A11 | 70.52 | 0.00 | 21, 22 |
| A12 | 109.48 | 0.00 | 23, 24 |
| A13 | 160.52 | 0.00 | 25, 26 |

(*the bearing of this axis may be assigned any value between 0° and 360°).

It will be appreciated that the configuration described above for the die of the present embodiment provides that the die, when rolled, is essentially unbiased.

The dice 20 of the present embodiment may be fabricated with the similar fabrication method and using the same materials as described above with reference to FIGS. 2A, 2B, 3A, and 3B.

INDUSTRIAL APPLICABILITY

The faces of the dice made in accordance with the above described arrangements may be marked with any desired indicia during the molding process or by cutting, etching, engraving or in any other suitable manner as recognized by those skilled in the art. For example, the fourteen faced die (first embodiment) may be marked to display a complete suit of cards (including a joker) if the die is to be used (perhaps with others marked with other cards) in a "card" type game. Similarly, two twenty-six faced dice may be marked with different values and suits of cards to provide a complete "deck" of cards (excluding jokers). Alternatively, the twenty-six faced die may simply be marked with the numbers 1 to 26 or with the letters of the alphabet to enable a user to select at random one of the twenty-six letters or numbers thereon.

From the foregoing description, it can be seen that the present invention comprises improved dice. It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. A die comprising a center and a plurality of faces arranged in opposed pairs on opposite sides of said center, said faces being substantially identical and substantially equally spaced from the center of the die, each of said faces including a center point substantially lying on an axis passing through the center of the die, said axes being substantially symmetrically spaced one from the other relative to the center of the die, wherein said plurality of faces comprises fourteen substantially circular faces defining seven equilength axes, said axes having bearings and elevations relative to a reference axis substantially as follows:

| AXIS | BEARING (°) | ELEVATION (°) |
|---|---|---|
| A1 | * | 90.00 |
| A2 | 0.00 | 0.00 |
| A3 | 90.00 | 0.00 |
| A4 | 45.00 | $Sin^{-1}(1/3)^{1/2}$ |
| A5 | 135.00 | $Sin^{-1}(1/3)^{1/2}$ |
| A6 | 225.00 | $Sin^{-1}(1/3)^{1/2}$ |
| A7 | 315.00 | $Sin^{-1}(1/3)^{1/2}$ |

(*the bearing of this axis may be assigned any value between 0°and 360°).

2. A die comprising a center and a plurality of faces arranged in opposed pairs on opposite sides of said center, said faces being substantially identical and substantially equally spaced from the center of the die, each of said faces including a center point substantially lying on an axis passing through the center of the die, said axes being substantially symmetrically spaced one from the other relative to the center of the die, wherein said plurality of faces comprises twenty-six substantially circular faces defining thirteen equilength axes, said axes having bearings and elevations relative to a reference axis substantially as follows:

| AXIS | BEARING (°) | ELEVATION (°) |
|---|---|---|
| A1 | * | 90.00 |
| A2 | 0.00 | 0.00 |
| A3 | 90.00 | 0.00 |
| A4 | 45.00 | $Sin^{-1}(1/3)^{1/2}$ |
| A5 | 135.00 | $Sin^{-1}(1/3)^{1/2}$ |
| A6 | 225.00 | $Sin^{-1}(1/3)^{1/2}$ |
| A7 | 315.00 | $Sin^{-}(1/3)^{1/2}$ |
| A8 | 0.00 | 45.00 |
| A9 | 90.00 | 45.00 |
| A10 | 180.00 | 45.00 |
| A11 | 270.00 | 45.00 |
| A12 | 45.00 | 0.00 |
| A13 | 135.00 | 0.00 |

(*the bearing of this axis may be assigned any value between 0° and 360°).

3. A die comprising a center and a plurality of faces arranged in opposed pairs on opposite sides of said center, said faces being substantially identical and substantially equiangularly spaced from the center of the die, each of said faces including a center point substantially lying on an axis passing through the center of the die, said angular spacing between said axes being maximized in both bearing and elevation, wherein said plurality of faces comprises fourteen substantially circular faces defining seven equilength axes, said axes having bearings and elevations relative to a reference axis substantially as follows:

| AXIS | BEARING (°) | ELEVATION (°) |
|---|---|---|
| A1 | * | 90.00 |
| A2 | 0.00 | 0.00 |
| A3 | 90.00 | 0.00 |
| A4 | 45.00 | $Sin^{-1}(1/3)^{1/2}$ |
| A5 | 135.00 | $Sin^{-1}(1/3)^{1/2}$ |
| A6 | 225.00 | $Sin^{-1}(1/3)^{1/2}$ |

-continued

| AXIS | BEARING (°) | ELEVATION (°) |
|---|---|---|
| A7 | 315.00 | $Sin^{-1}(1/3)^{1/2}$ |

(*the bearing of this axis may be assigned any value between 0° and 360°).

4. A die comprising a center and a plurality of faces arranged in opposed pairs on opposite sides of said center, said faces being substantially identical and substantially equiangularly spaced from the center of the die, each of said faces including a center point substantially lying on an axis passing through the center of the die, said angular spacing between said axes being maximized in both bearing and elevation, wherein said plurality of faces comprises twenty-six faces substantially circular defining thirteen equilength axes, said axes having bearings and elevations relative to a reference axis substantially as follows:

| AXIS | BEARING (°) | ELEVATION (°) |
|---|---|---|
| A1 | * | 90.00 |
| A2 | 0.00 | 0.00 |
| A3 | 90.00 | 0.00 |
| A4 | 45.00 | $Sin^{-}(1/3)^{1/2}$ |
| A5 | 135.00 | $Sin^{-}(1/3)^{1/2}$ |
| A6 | 225.00 | $Sin^{-(1/3)1/2}$ |
| A7 | 315.00 | $Sin^{-}(1/3)^{1/2}$ |
| A8 | 0.00 | 45.00 |
| A9 | 90.00 | 45.00 |
| A10 | 180.00 | 45.00 |
| A11 | 270.00 | 45.00 |
| A12 | 45.00 | 0.00 |
| A13 | 135.00 | 0.00 |

(*the bearing of this axis may be assigned any value between 0° and 360°).

5. A die comprising a center and a plurality of faces arranged in opposed pairs on opposite sides of said center, said faces being substantially identical and substantially equiangularly spaced from the center of the die, each of said faces including a center point substantially lying on an axis passing through the center of the die, said angular spacing between said axes being maximized in both bearing and elevation, wherein said plurality of faces comprises twenty-six substantially circular faces defining thirteen equilength axes, said axes having bearing and elevations relative to a reference axis substantially as follows:

| AXIS | BEARING (°) | ELEVATION (°) |
|---|---|---|
| A1 | * | 90.00 |
| A2 | 0.00 | 51.04 |
| A3 | 90.00 | 51.04 |
| A4 | 180.00 | 51.04 |
| A5 | 270.00 | 51.04 |
| A6 | 45.00 | 30.49 |
| A7 | 135.00 | 30.49 |
| A8 | 225.00 | 30.49 |
| A9 | 315.00 | 30.48 |
| A10 | 19.48 | 0.00 |
| A11 | 70.52 | 0.00 |
| A12 | 109.48 | 0.00 |
| A13 | 160.52 | 0.00 |

(*the bearing of this may be assigned any value between 0° and 360°).

* * * * *